US007268312B2

(12) United States Patent
Chen

(10) Patent No.: US 7,268,312 B2
(45) Date of Patent: Sep. 11, 2007

(54) BUTTON PROTECTING STRUCTURE

(75) Inventor: Chun-Yao Chen, Miao-Li (TW)

(73) Assignee: Coretronic Corporation, Miao-Li County (TW)

( * ) Notice: Subject to any disclaimer, the term of this patent is extended or adjusted under 35 U.S.C. 154(b) by 236 days.

(21) Appl. No.: 11/227,221

(22) Filed: Sep. 16, 2005

(65) Prior Publication Data

US 2006/0084305 A1 Apr. 20, 2006

(30) Foreign Application Priority Data

Oct. 19, 2004 (TW) ..... 93131655 A

(51) Int. Cl.
*H01H 13/70* (2006.01)

(52) U.S. Cl. ..... 200/343; 200/296

(58) Field of Classification Search ..... 200/5 A, 200/512, 517, 520, 296, 341, 343, 345; 341/22; 345/168, 169

See application file for complete search history.

(56) References Cited

U.S. PATENT DOCUMENTS 5,360,955 A * 11/1994 English et al. ..... 200/343
5,749,457 A * 5/1998 Castaneda et al. ..... 200/343
6,492,605 B2 * 12/2002 Iida ..... 200/343
6,914,206 B2 * 7/2005 Mukougawa ..... 200/341
7,019,237 B2 * 3/2006 Hong ..... 200/296
7,098,417 B1 * 8/2006 Fuji ..... 200/343

* cited by examiner

*Primary Examiner*—Michael A Friedhofer
(74) *Attorney, Agent, or Firm*—Bacon & Thomas, PLLC

(57) ABSTRACT

A button protecting structure is for an electronic product. The electronic product comprises a housing, a printed circuit board (PCB) installed in the housing, and a button module installed in the housing and touchable with the PCB to execute specific functions. The button module has a plurality of bridge sections in which one end of each bridge section is positioned in the housing. The button protecting structure comprises a connection unit and a stopping unit extended from the connection unit. The connection unit is detachably positioned in the housing and located at one side of the PCB. And, the stopping unit is extended and installed at a bottom of the PCB and positioned in a displacement path of each button. Whereby, a plurality of electronic elements or the PCB is prevented from being damaged and broken owing to an overdoing exerted force generated an accidental pressing on the button.

10 Claims, 5 Drawing Sheets

BUTTON PROTECTING STRUCTURE

BACKGROUND OF THE INVENTION

1. Field of the Invention

The present invention relates to a button protecting structure, and more particularly to the button protecting structure of an electronic product capable for protecting a plurality of electronic elements or a printed circuit board (PCB) from being damaged or broken owing to an overdoing force exerted when a button is accidentally pressed.

2. Description of Related Art

Please refer to FIG. 1. A conventional television set 1 comprises a screen main body 11, a base seat 12 positioned below the screen main body 11 and two supporting shafts 13 respectively vertically disposed between the screen main body 11 and the base seat 12. A plurality of function buttons 111 for a user to process pressing operations to execute specific functions is installed on the screen main body 11. For an artistic outlook, the function buttons 111 are generally installed at a bottom of the screen main body 11.

However, a volume of the screen main body 11 is larger than a volume of the base seat 12, when the television set 1 is moved, for keeping balance, a user's hands 4 always hold the screen main body 11 at the positions close to the corners of the bottom thereof such that the function buttons 111 are always accidentally pressed. As FIG. 2 shows, when a user accidentally presses the function buttons 111 during the transportation processing, a printed circuit board (PCB) 14 installed above the function buttons 111 is easily pressed upward thereby owing to an overdoing force. This leads to a situation that the PCB 14 is broken or separated from a housing of the television set 1. Furthermore, a touch control switch 141 being disposed on the PCB 14 and triggered by the function buttons 111 is caused to damage.

SUMMARY OF THE INVENTION

One object of the present invention is to provide a button protecting structure for an electronic product, capable of preventing a plurality of electronic elements and a printed circuit board (PCB) in the electronic product from being damaged or broken owing to an overdoing force when a plurality of buttons is accidentally pressed.

For attaining to the object mentioned above, the electronic product of the present invention comprises a housing, a PCB installed in the housing, and a button module installed in the housing and capable of touch controlling the PCB to execute specific functions. The button module has a plurality of bridge sections in which one end of each bridge section is fixed in the housing, and a plurality of buttons in which each button respectively extended from each bridge section and protruded out of the housing for allowing a user to process pressing operations to cause them to move up and down relatively to the housing. A button protecting structure of the present invention has a connection unit and a stopping unit. The connection unit is detachable installed in the housing and positioned at one side of the PCB. Besides, the stopping unit is extended from the connection unit and installed at a bottom of the PCB and positioned in a displacement path of each button.

The button protecting structure according to the present invention allows the buttons not to be pressed directly against the electronic elements on the PCB when the overdoing force is exerted on the PCB owing to an accidental button pressing by extending the stopping unit to the bottom of the PCB and positioning it in the displacement path of each button. An excessive exerted force is directly acted on the stopping unit. Whereby, the electronic elements or the PCB in the electronic product are prevented from being damaged or broken.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
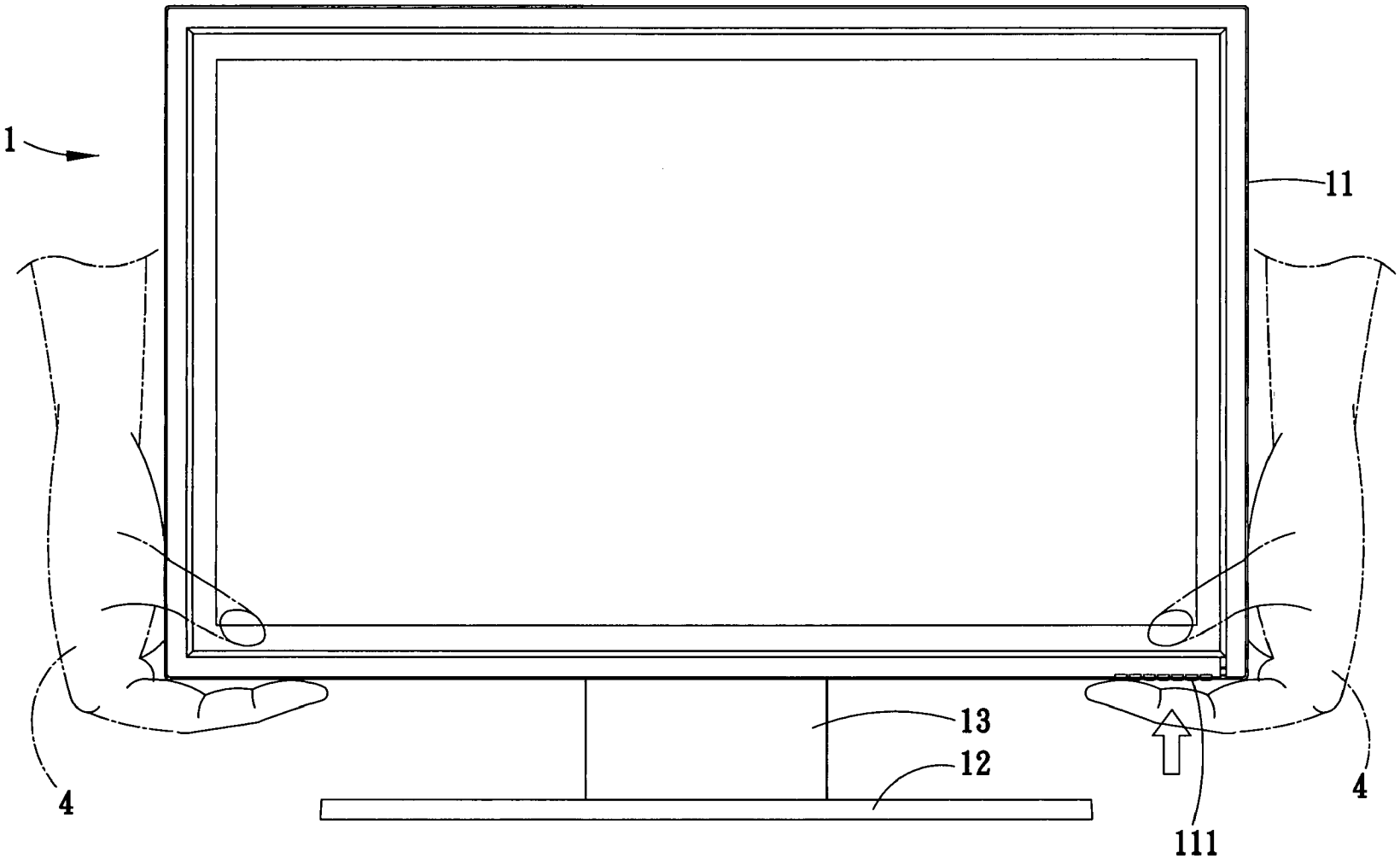
FIG. 1 (PRIOR ART)
FIG. 1 is a schematic view of a conventional television.
Figure 2:
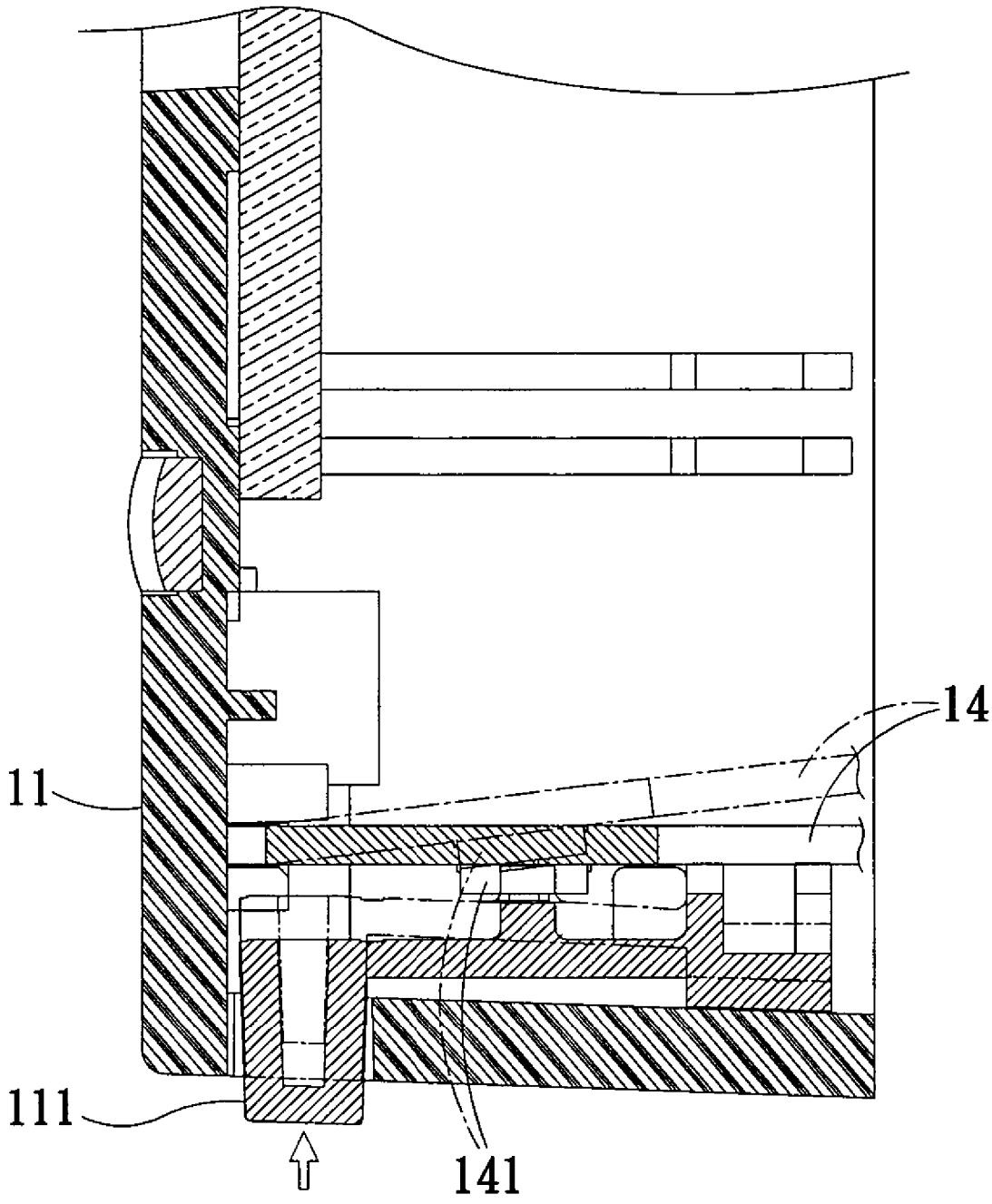
FIG. 2 (PRIOR ART)
FIG. 2 is a partial cross sectional view of a conventional television.
Figure 3:
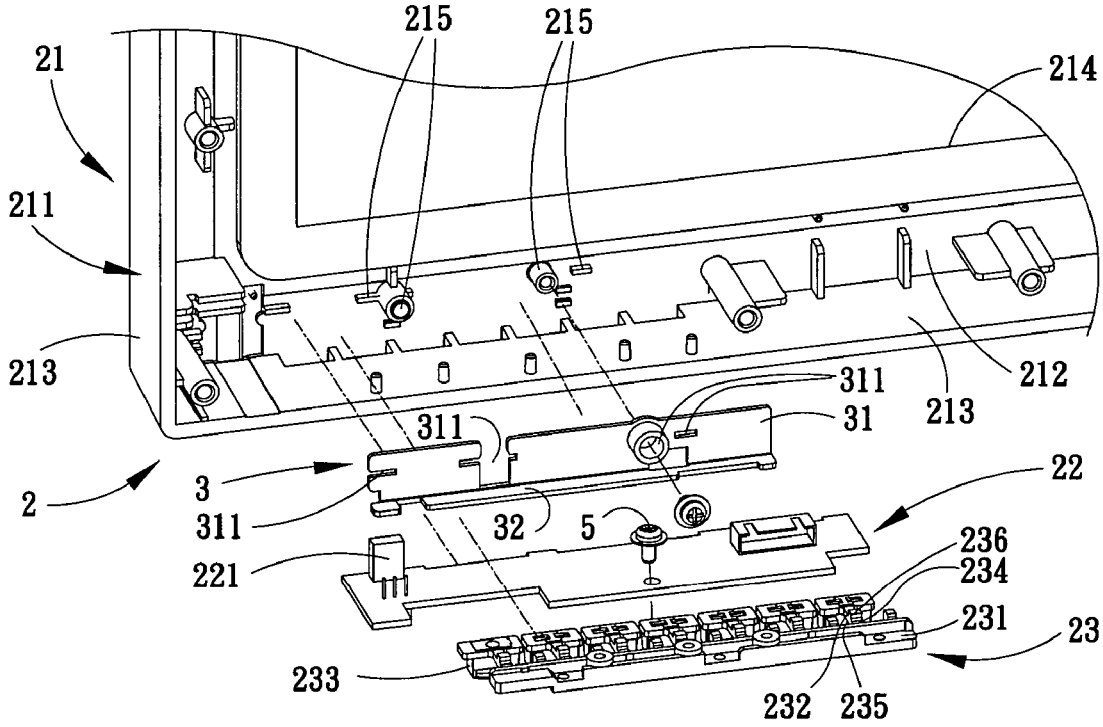
FIG. 3 is an exploded view showing a button protecting structure of a preferred embodiment according to the present invention.

Please refer to FIG. 3. FIG. 3 is an exploded view showing a button protecting structure of an electronic product of a preferred embodiment according to the present invention. The electronic product 2 is a computer screen, a television and etc. In the embodiment, the electronic product 2 is the television as an example to explain a detail. The electronic product 2 comprises a housing 21, a printed circuit board (PCB) 22 installed in the housing 21, and a button module 23.

The housing 21 has a first frame 211 and a second frame (not shown in the figure) connected in pair and combined into one body with the first frame 211. The first frame 211 has a central wall 212 and a plurality of surrounding walls 213 disposed around the central wall 212, in which an opening 214 for allowing a display screen to be installed therein is disposed on the central wall 212 and at least one element as a first interference element 215 is disposed on an inner surface of the central wall 212 and close to a bottom of the surrounding wall 213. The first interference element 215 is formed as a protruding shape or a cylinder shape. The second frame also has a central back wall corresponding to the central wall 212 of the first frame 211 and a plurality of surrounding walls disposed around the central back wall. Because the second frame is not the target of the present invention, the detailed description thereof is omitted here.

Figure 4:
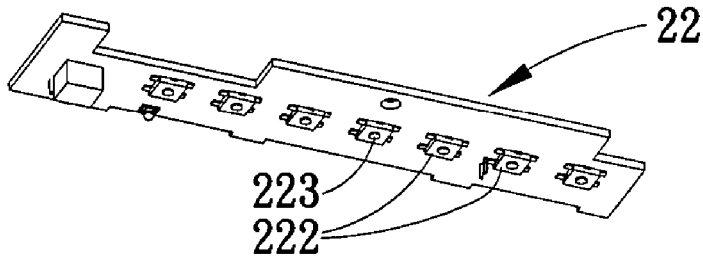
FIG. 4 is a bottom view showing a printed circuit board of a preferred embodiment according to the present invention.

As shown in FIG. 3 and FIG. 4, a plurality of electronic elements 221 is arranged on a top surface of the PCB 22, in which a part of the electronic elements are touch control switches 222. Each touch control switch 222 has a touch button 223 protruded from a bottom surface of the PCB 22.

Figure 5:
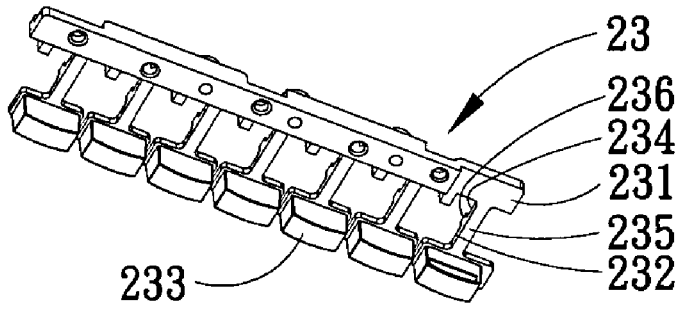
FIG. 5 is a bottom view showing a button module of a preferred embodiment according to the present invention.
Figure 6:
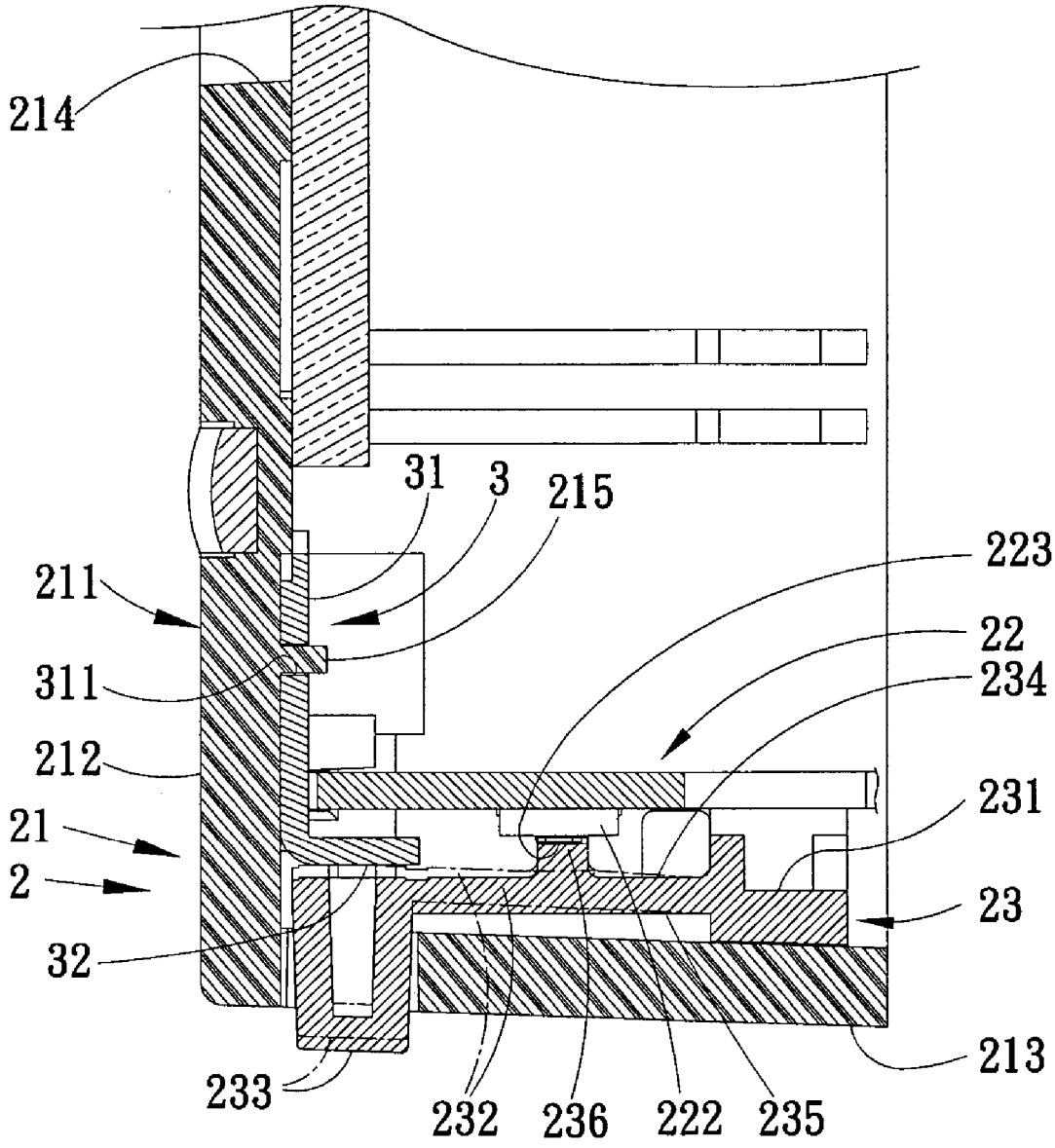
FIG. 6 is a partial cross sectional view showing a combination of a button protecting structure and a television of a preferred embodiment according to the present invention.

Please refer to FIGS. 5 and 6. The button module 23 has a connection section 231 fixed on the surrounding wall 213 of the first frame 211, a plurality of bridge sections 232 extended from the connection section 231 and a plurality of buttons 233 respectively extended from each bridge section 232 and protruded out of the bottom of the surrounding wall 213 of the housing 21 close to a corner thereof. Each bridge section 232 has a top surface 234 and a bottom surface 235 opposite to each top surface 234. A plurality of propping pieces 236 respectively corresponding to each touch button 223 is protruded from each top surface 234. Each button 233 is extended from the bottom surface 235 of each bridge section 232. Besides, one side of the PCB 22 is fixed and positioned onto the connection section 231 of the button module 23 through a locking element 5 such as a screw.

Furthermore, a button protecting structure 3 has a connection unit 31 and a stopping unit 32 extended from the connection unit 31. The connection unit 31 and the stopping unit 32 are constructed to be an L-shaped sheet. At least one element as a second interference element 311 capable of generating an interference function with the first interference element 215 of the housing 21 is disposed on the connection unit 31, the second interference element 311 is a hole or a breach for allowing the first interference element 215 to be extended and installed therein.

The button protecting structure 3 is installed in the housing 21, and the first interference element 215 is extended and installed into the second interference element 311 so as to yield an interference function to each other. Whereby, the connection unit 31 can then be positioned on the inner surface of the central wall 212 of the housing 21. In the meantime, the stopping unit 32 is extended to the bottom of the PCB 22 and positioned in a displacement path of each button 233. Furthermore, the distance between the stopping unit 32 and the top surface 234 of the bridge 232 is slightly smaller than the height of each propping piece 236.

Whereby, when the electronic product 2 is moved or transported, even if the user's hand accidentally presses on one of the buttons 233, causes the button 233 to move upward, it only moves the propping piece 236 on the bridge section 232 together therewith to slightly press the touch button 223 of the touch control switch 222 (the same as the touch in a normal use state). An overdoing force exerted on the button 233 is allowed to exerted directly on the stopping unit 32 by utilizing that the distance between the stopping unit 32 and the top surface 234 of the bridge section 232 is slightly smaller than the height of each propping piece 236 so that the touch button 233 is not more propped upward against continuously. Therefore, the electronic elements (particularly to the control switches 222) on the PCB 22 or even the PCB 22 itself can be prevented from being damaged or broken owing to the overdoing propping-upward force.

To sum up, the button protecting structure 3 for the electronic product 2 according to the present invention is constructed to an L-shaped sheet through the connection unit 31 and the stopping unit 32. The connection unit 31 is positioned on the inner surface of the housing 21 of the electronic product 2, and in the meantime the stopping unit 32 is then extended and installed at the bottom of the PCB 22 and positioned in the displacement path of the each button 233. In addition, the distance between the stopping unit 32 and the top surface 234 of the bridge section 232 is slightly smaller than the height of a propping piece 236 to allow the button 233 not to be propped upward directly against the electronic elements installed on the PCB 22 when the exerted force accidentally pressed on the button is overdoing, the unnecessary exerted force will be directly applied on the stopping unit 32 so as to prevent the electronic elements in the electronic product from being damaged and the PCB from being broken, therefore, the object of the present invention can be accurately attained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A button protecting structure for an electronic product, installed in said electronic product, said electronic product comprising a housing, a printed circuit board installed in said housing and a button module installed in said housing and touchable with said printed circuit board to execute specific functions, said button module having a plurality of bridge sections, one end of each of the bridge sections positioned in said housing and a plurality of buttons respectively extended from each of the bridge sections and protruded out from said housing, said buttons providing pressing operations to be moved up and down relatively to said housing, said button protecting structure comprising:

a connection unit, detachably positioned in said housing and located at one side of said printed circuit board; and a stopping unit, extended from said connection unit, extended and installed at a bottom of said printed circuit board and positioned in a displacement path of each of the buttons.

2. The button protecting structure according to claim 1, wherein an L-shaped sheet is constructed from said connection unit and said stopping unit.

3. The button protecting structure according to claim 1, wherein a plurality of touch control switches is disposed on a bottom of said printed circuit board, each of said bridge sections has a top surface and a bottom surface opposite to said top surface, a plurality of propping pieces used for propping upward against each of the touch control switches is protruded out from places on said top surface relatively each of the touch control switches a distance between said stopping unit and said top surface of each of said bridge sections is slightly smaller than a height of each of the propping pieces.

4. The button protecting structure according to claim 1, wherein at least one first interference element is disposed on an inner surface of said housing, and at least one second interference element used to generate an interference function with said first interference element is disposed on said connection unit, said connection unit is positioned in said housing by interfering said first and said second interference elements with each other.

5. The button protecting structure according to claim 4, wherein said at least one first interference element is a protrusion, and said at least one second interference element is a hole for allowing said protrusion to be extended and installed therein.

6. A button protecting structure for an electronic product, said electronic product comprising a housing, a printed circuit board and a button module, said button module under said printed circuit board and touchable with said printed circuit board to execute specific functions, said button module having a plurality of bridge sections, one end of each of the bridge sections positioned in said housing and a plurality of buttons respectively extended from each of the bridge sections and protruded out from said housing, said buttons providing pressing operations to be moved up and down relatively to said housing, said button protecting structure comprising:

a connection unit, detachably positioned in said housing and located at one side of said printed circuit board; and a stopping unit, connected to said connection unit and installed between said printed circuit board and said button module.

7. The button protecting structure according to claim 6, wherein an L-shaped sheet is constructed from said connection unit and said stopping unit.

8. The button protecting structure according to claim 6, wherein said stopping unit is positioned in a displacement path of each of the buttons.

9. The button protecting structure according to claim 6, wherein a plurality of touch control switches is disposed on a bottom of said printed circuit board, each of said bridge sections has a top surface and a bottom surface opposite to said top surface, a plurality of propping pieces used for propping upward against each of said touch control switches is protruded out from places on said top surfaces relatively to each of the touch control switches.

10. The button protecting structure according to claim 9, wherein a distance between said stopping unit and said top surface of each of said bridge sections is slightly smaller than a height of each of the propping pieces.

* * * * *